US006264112B1

(12) United States Patent
Landschoot et al.

(10) Patent No.: US 6,264,112 B1
(45) Date of Patent: Jul. 24, 2001

(54) ENGINE FUEL INJECTOR

(75) Inventors: Timothy P. Landschoot, Henrietta; Robert B. Perry, Leicester; Karl Jacob Haltiner, Jr.; Peter Ronald Wendt, both of Fairport; Chester Henry Ciesinski, Adams Basin; Otto Muller-Girard, Jr., Rochester; James Robert Molnar, Penfield, all of NY (US); Michael Brian Lavan, Holland, MI (US); John David Vanderhenst, Grand Rapids, MI (US); Todd A. Bordewyk, Hudsonville, MI (US); Jeffrey M. Stuecken, Marne, MI (US); Michael Schneider, Rochester, NY (US); Harrie William Bonnah, II, East Grand Rapids, MI (US); Corrine Ann Volo, Webster, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/320,501

(22) Filed: May 26, 1999

(51) Int. Cl.[7] ..... F02D 1/06

(52) U.S. Cl. ..... 239/5; 239/585.1

(58) Field of Search ..... 239/5, 585.1, 585.2, 239/585.3, 585.4, 585.5, 551, 461, 499, 504, 518, 523, 524, 892; 251/129.21, 129.18, 129.15; 123/456

(56) References Cited

U.S. PATENT DOCUMENTS

| | | | | |
|---|---|---|---|---|
| 4,274,598 | * | 6/1981 | Wilfert et al. | 239/585.1 |
| 4,742,964 | * | 5/1988 | Ito et al. | 239/551 |
| 5,694,898 | * | 12/1997 | Pontoppidan et al. | 123/456 |
| 5,803,052 | * | 9/1998 | Lorraine et al. | 123/456 |
| 5,875,972 | * | 3/1999 | Ren et al. | 239/585.4 |
| 5,915,626 | * | 6/1999 | Awarzamani et al. | 239/585.1 |

* cited by examiner

*Primary Examiner*—Lisa Ann Douglas
(74) *Attorney, Agent, or Firm*—John A. VanOphem

(57) ABSTRACT

A fuel injector for an engine includes a continuous endoskeletal injector tube enclosing an imperforate continuous passage for fuel flow from an inlet end to an outlet end of the tube. A valve seat, injection valve, tubular magnetic pole, biasing spring and adjusting sleeve are mounted within the tube, optionally with other elements, all being exposed to fuel in the passage defined by the tube. A solenoid coil and a magnetic body together with mounting components and seals are mounted on the exterior of the tube where they are protected from exposure to the fuel, which is restricted to passage within the continuous tube. The body, pole and armature form a magnetic flux concentrating path operative to attract the armature to the pole and open the valve when the coil is energized. The solenoid coil may be preassembled with its connector in a body forming a separate coil assembly for subsequent installation on the injector tube. During assembly, the tubular pole may be adjusted to set the desired stroke of the injection valve prior to fixing the pole in the tube. Various other features are also disclosed.

30 Claims, 5 Drawing Sheets

ENGINE FUEL INJECTOR

TECHNICAL FIELD

This invention relates to engine fuel injectors. A particular embodiment involves a solenoid actuated fuel injector including an endoskeletal continuous tube within which fuel flow is contained and which supports the various components making up the injector.

BACKGROUND OF THE INVENTION

It is well known in the automotive engine art to provide solenoid actuated fuel injectors for controlling the injection of fuel into the cylinders of spark ignition engines, generally through intake manifold runners or intake ports of the cylinders. Generally, such injectors include a body having added internal and external components which are assembled and welded, brazed or otherwise sealed together to provide internal fuel passages for conducting fuel flow. In some designs, the actuating solenoid coil is exposed to fuel passing through the injector. Such injectors may also involve assembly of many small components housed within a body having an internal coil joined with a connector and enclosed by an overmolded protective material.

It is desirable to provide an injector having reduced complexity and assembly costs as well as improved protection against fuel leakage and coil failures.

SUMMARY OF THE INVENTION

The present invention provides a novel injector having a number of improved features combined in a preferred embodiment. Some of the features are optionally combinable with other forms of injectors and components to provide various combinations of components and features.

A primary feature of the invention is that it includes a continuous endoskeletal tube enclosing a continuous passage for fuel flow through the injector from an inlet end to an outlet end of the tube. In general, the tube provides a skeleton or support within or on which all the other components of the injector are mounted.

A valve seat is fixed at the outlet end of the tube which may have a straight or expanded outlet end for supporting the valve seat.

An injection valve is slidable within the tube and is biased against the valve seat to close off fuel flow therethrough. The valve has an armature which is attracted to a tubular pole mounted within the tube by energizing of a coil surrounding the tube. Optionally, the tubular pole may be adjusted during assembly to establish the operating stroke of the valve prior to fixing the tubular pole in the adjusted position.

The electrical coil may be formed as a coil assembly including an attached connector with enclosed terminals. The complete coil assembly has a central opening through the coil that allows the coil assembly to be slipped over the tube during assembly of the injector. The continuous tube prevents fuel in the internal passage from contacting the coil and other elements that are mounted on the exterior of the tube.

A magnetic body or strap at least partially surrounds the coil and has upper and lower ends connected with the exterior of the tube to form a magnetic flux concentrating path through the body, coil and armature so as to attract the armature to the pole when the coil is energized.

A separate tubular or hollow component or support element may be provided which is assembled over the tube to engage and possibly surround the coil body. The support element may include a clip groove for connecting the support element and the injector to an associated fuel rail by means of a retaining clip or other suitable retaining means. The support element may also provide a backup surface for an inlet end seal ring which may be retained in place by a push-on rail seal retainer forced over the inlet end of the injector tube and retained by friction or other suitable means.

Various embodiments of valve seats and/or associated components are possible.

In one embodiment having a straight line tube, a valve seat is secured to the outlet end of the tube and includes an integral multi-hole director for directing fuel spray from one or more openings in the valve seat which are controlled by the associated valve.

In other embodiments, the outlet end of the tube is expanded to form a short cylindrical portion in which a valve seat is received and retained by crimping over the outlet end of the tube. A lower guide disc may be seated in the cylindrical portion between the valve seat and a flange formed by the outwardly expanded portion of the tube. A discharge opening in the valve seat may connect with a circular recess in which a director having multiple spray directing holes is retained. The director may be a disc element retained by a press fitted cup-shaped member. Alternatively, the director may be formed as a cup-shaped member retained by press fitting. Either of these versions could be supplementally retained by tack welding or other means for positively holding the retainer in place.

These and other features and advantages of the invention will be more fully understood from the following description of certain specific embodiments of the invention taken together with the accompanying drawings.

DESCRIPTION OF THE PREFERRED EMBODIMENT

Figure 1:
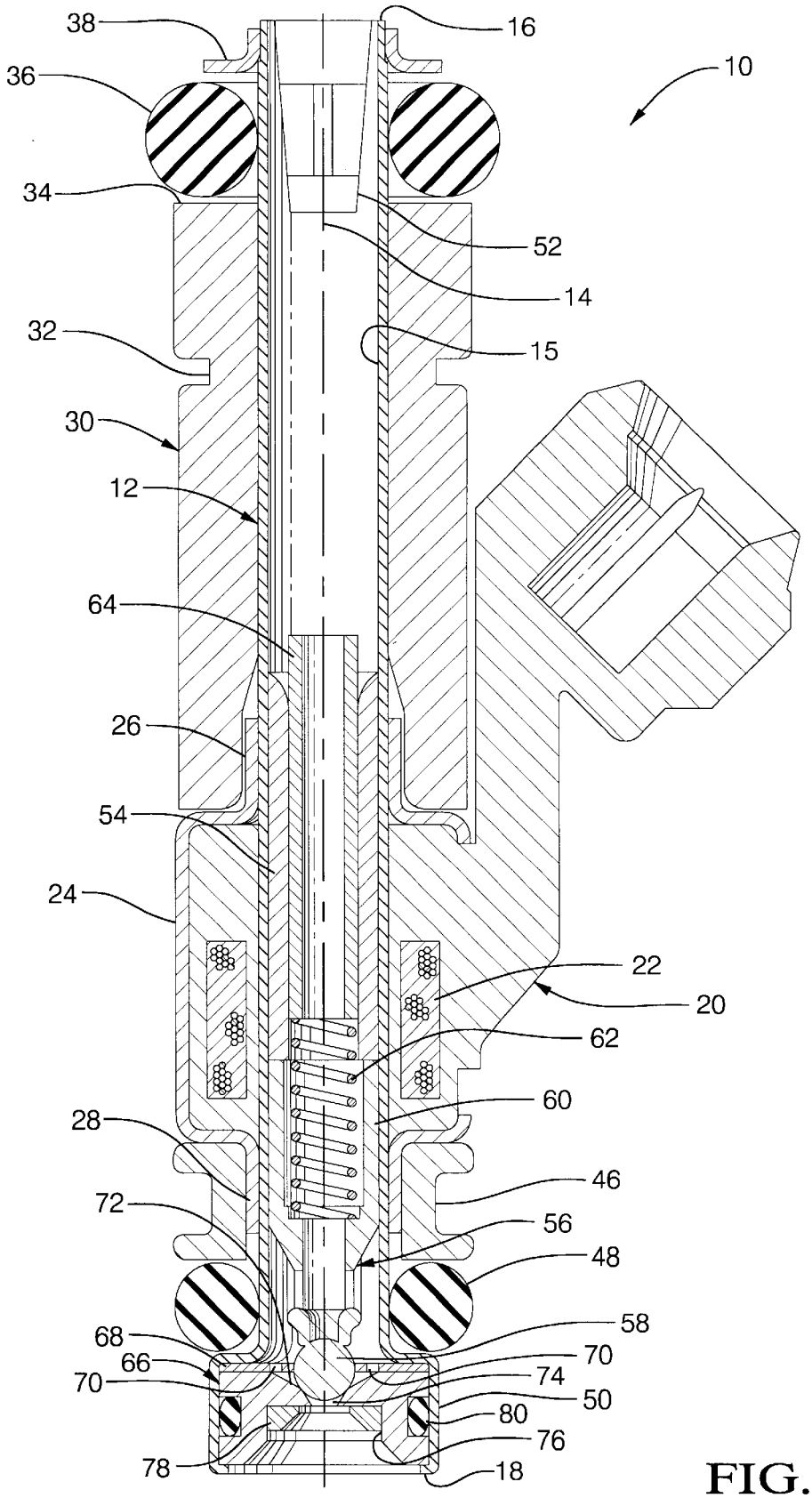
FIG. 1 is a transverse cross-sectional view along the axis of a preferred embodiment of fuel injector according to the invention.

Referring first to FIG. 1 of the drawings in detail, numeral 10 generally indicates a solenoid actuated fuel injector having many of the 10 features of the present invention. Injector 10 includes a continuous endoskeletal injector tube 12 which is centered on a central axis 14 and encloses a continuous passage 15 through the injector from an inlet end 16 of the tube to an outlet end 18. Preferably, the tube 12 has no openings except at the inlet and outlet ends and defines a continuous imperforate passage in which fuel is conducted and kept separate from all the components of the injector that are mounted externally of the tube. These include a separately formed coil assembly 20 including a solenoid coil 22 extending around and closely adjacent to the tube but isolated thereby from the fuel in the tube. A magnetic coil body or strap 24 surrounds the coil 22 and has upper and lower ends 26, 28 fixed to the outer surface of the tube.

A support element 30 is formed as a tubular member that slides over the tube and engages the body 24 surrounding an upper portion thereof. The support element includes a slot 32 for receiving a retainer clip, not shown, that holds the injector inlet end within a cup, not shown, of an associated fuel rail. The support element also provides a backup surface 34 at one end for constraining a seal ring 36 of the conventional O-ring type. A push-on seal retainer 38 is frictionally or otherwise retained on the inlet end 16 of the injector tube 12 to form with the other parts an annular groove in which the seal ring 36 is retained. A split spacer ring 46 extends around the lower end of the body 24 and engages an annular O-ring seal 48 which is retained, in part, by an expanded diameter portion 50 at the lower end of the injector tube 12.

Within the injector tube 12, an inlet fuel filter 52 is provided at the inlet end of the tube. A tubular magnetic pole is fixed within the tube in engagement with its interior surface. The pole extends from adjacent the upper end 26 of the body 24 to a position within the axial extent of the coil 22. An injection valve 56 is reciprocable within the tube 12 and includes a ball end 58 connected with a hollow armature 60 that slides within the tube. A biasing spring 62 engages the armature and an adjusting sleeve 64 fixed within the magnetic pole 54 to urge the injection valve downward toward a closed position.

Within the expanded diameter portion 50 of the tube 12, a valve seat 66 and a lower valve guide 68 are retained by crimped over portions of the tube outlet end 18. The lower valve guide 68 is a disc positioned between the valve seat and a flange-like surface formed by the expanded diameter tube portion 50 to guide the ball end 58 of the injection valve. The disc includes openings 70 to allow fuel flow through the guide 68 to a conical surface 72 of the valve seat against which the ball end 58 seats in the valve closed position. A central discharge opening 74 of the valve seat 66 connects the conical surface 72 with a circular recess 76 in which a multi-hole spray director 78 is press fitted or otherwise retained. An outer seal ring 80 is captured in a groove of the valve seat and prevents fuel from leaking around the valve seat and bypassing the discharge opening 74.

To properly control the speed and efficiency of valve action in a solenoid actuated injector, it is important that the valve stroke be established at a desired predetermined value. Typically, this has been accomplished by making the position of the valve seat adjustable relative to the body of the injector. The present invention avoids the complexity of providing an adjustable seat position by making the magnetic pole 54 adjustable within the tube 12 in order to establish the desired clearance between the pole and the valve armature in the valve closed position. This is done by sliding the pole inside the tube prior to its being fixed to the tube in order to retain the valve stroke at the adjusted position. In a similar manner, adjusting sleeve 64 is slidable within the tubular pole 54 in order to provide the proper compression of spring 62 which biases the valve against the valve seat in the closed position.

In operation, energizing of the coil 22 draws the armature 60 upward into engagement with the end of the magnetic pole 54, moving the ball end 58 of valve 56 upward away from the conical surface 72 of the valve seat 66. Fuel is then allowed to flow through the tube 12 and valve seat 66 and out through the director 78 into an associated intake manifold or inlet port of an associated engine, not shown. Upon de-energization of the coil 22, the magnetic field collapses and spring 62 seats the valve 56 on conical surface 72, cutting off further fuel injection flow.

Figure 2:
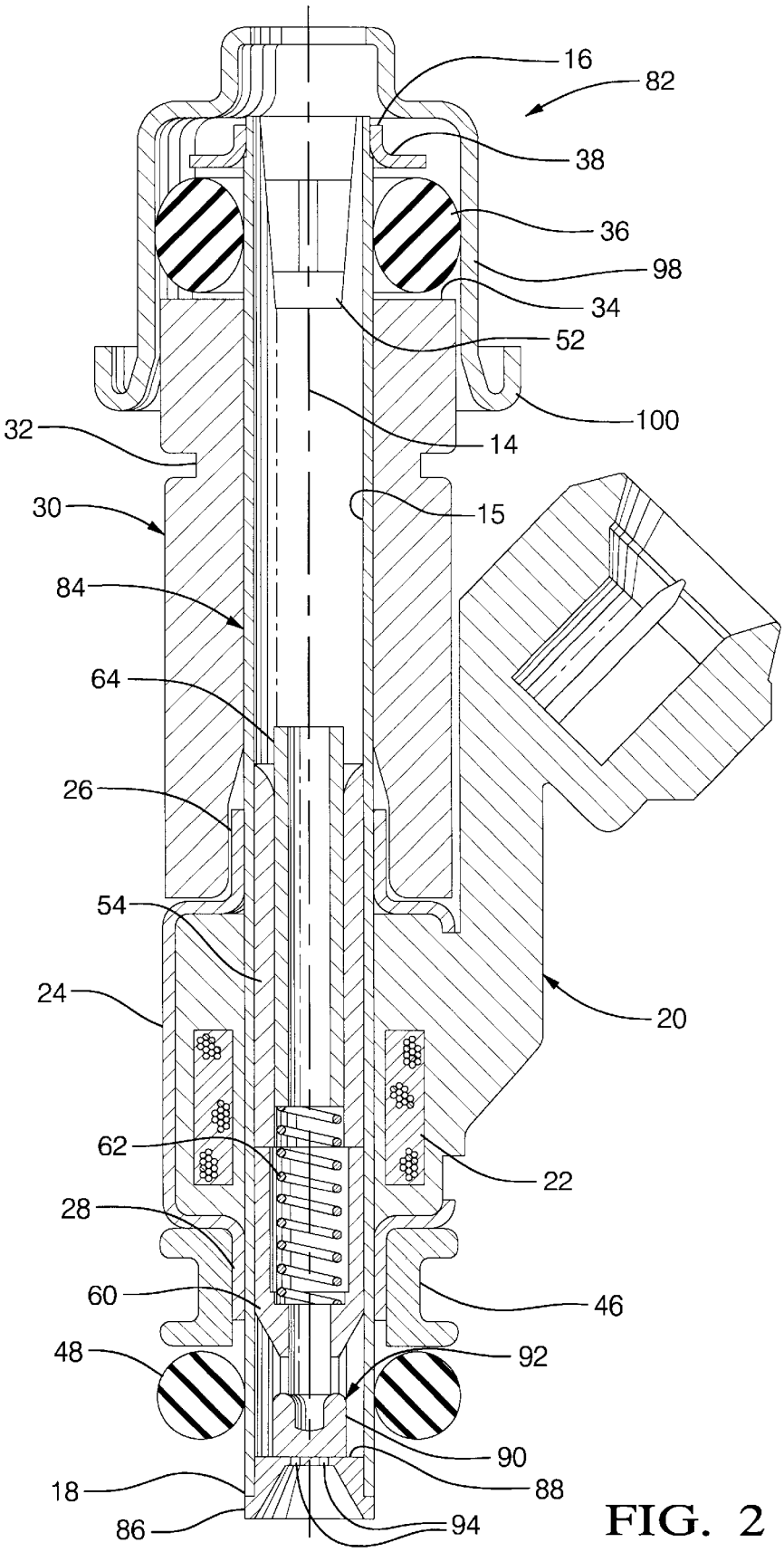
FIG. 2 is a view similar to FIG. 1 but showing an alternative embodiment of fuel injector together with a cup of an associated fuel rail.

Referring now to FIG. 2 of the drawings, numeral 82 generally indicates an alternative embodiment of an injector formed according to the invention. Except for the outlet end, injector 82 is essentially similar in construction to injector 10 previously described so that like numerals are used to indicate like parts, as to which further description is not believed required.

Injector 82 differs in that its continuous endoskeletal tube 84 does not have an expanded diameter portion at the lower end but instead is a straight tube with a constant diameter between its opposite ends 16, 18. If desired the tube could have varying diameters, for example as in FIG. 1. A valve seat 86 is fixed in the lower end 18 by welding or in any suitable manner. The valve seat includes a flat seat surface 88 that is engaged by a valve element 90 having a flat surface that seats against the valve seat surface 88 to close the valve. The valve element 90 forms part of an injection valve 92 that includes an armature 60 reciprocable in the tube 84 as in the previous embodiment. Within the flat surface 88, the valve seat 86 provides an integral spray director comprising a plurality of openings 94 for directing fuel spray discharged from the injector when the valve is open. A conventional O-ring seal 48 seals the lower end of the tube as in the embodiment of FIG. 1.

The inlet end of the injector, adjacent tube end 16, is illustrated as being inserted within a fuel rail cup 98 of an associated fuel rail, not shown. The cup includes a lip 100 which may be gripped by a clip, not shown, that also engages the slot 32 in the support element 30 to retain the injector within the cup 98. Operation of injector 82 is identical to that of injector 10 so that further description is not required.

Figure 3:
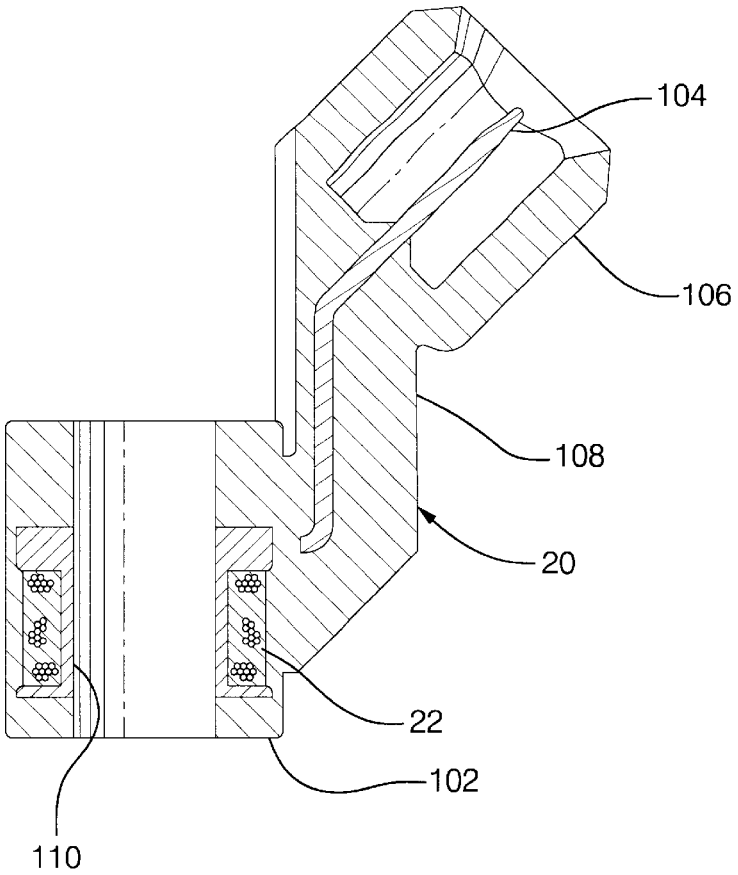
FIG. 3 is a cross-sectional view of a separately formed coil assembly for use with the injectors of FIGS. 1 and 2.

FIG. 3 illustrates in cross section the coil assembly 20 which is usable with both of the previously described injectors. Assembly 20 includes the wire solenoid coil 22 which is wrapped around a bobbin 102 in a conventional manner. The coil 22 is electrically connected by means, not shown, to a pair of terminals 104, only one being shown, which extend outwardly into a connector end 106 of the coil assembly 20 for connection of the coil to an external electrical power source. The bobbin, coil and terminals are completely encased within a body 108 which is molded of suitable plastic material about the coil and terminals after they are positioned in their proper relationship. A through-opening 110 is provided extending axially through the coil to allow the coil assembly to be installed by sliding it over the tube 12 or 84 during the injector assembly process. Formation of the coil assembly with the terminal connector as a separate preassembled component, greatly simplifies the assembly process for the injector itself as will be subsequently further described.

Figure 4:
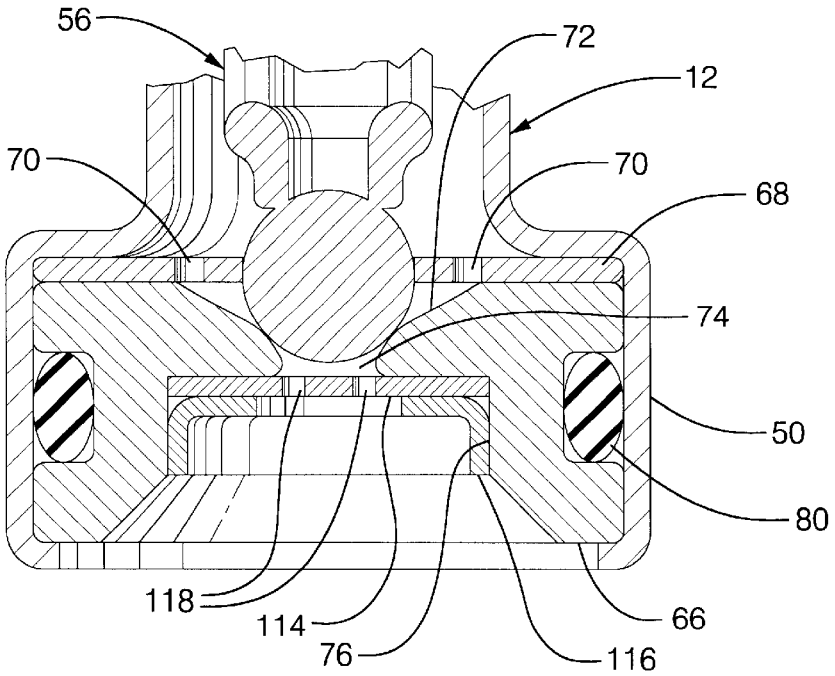
FIG. 4 is an enlarged view of the outlet end of the injector of FIG. 1 including an expanded tube portion in which a valve seat and lower guide are retained and including a disc director held in a circular outlet recess of the valve seat by a cup-shaped director retainer.
Figure 5:
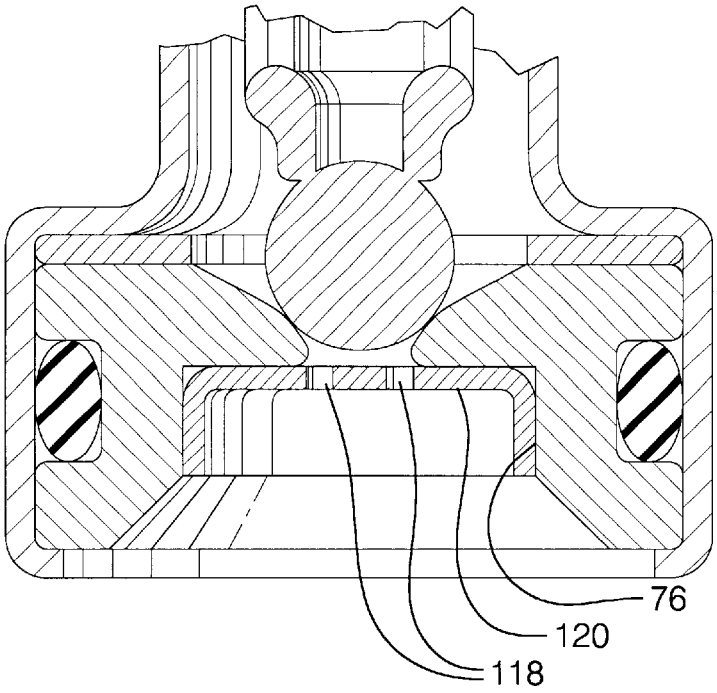
FIG. 5 is a view similar to FIG. 4 wherein the director is formed in a cup-shape and pressed into the circular recess.
Figure 6:
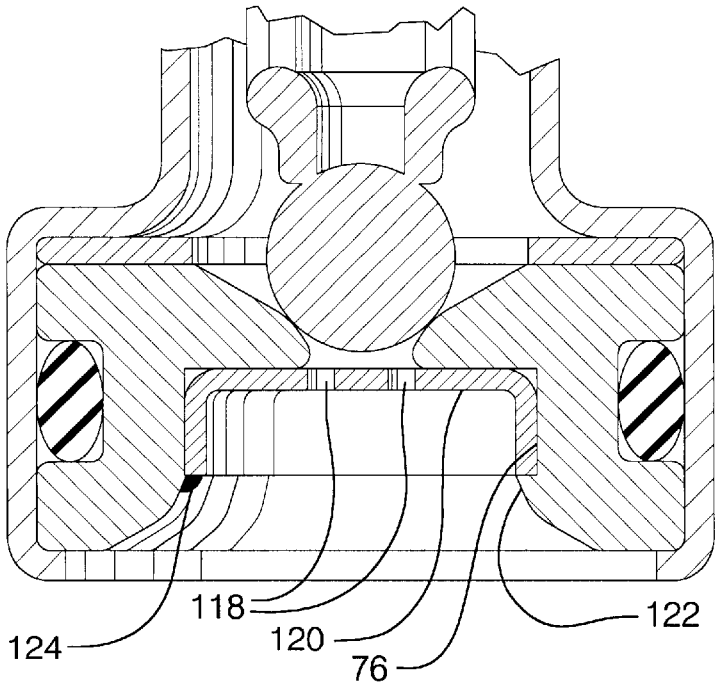
FIG. 6 is a view similar to FIG. 5 wherein the director is supplementally retained by the combination of a retention lip and a spot weld.

Referring now to FIGS. 4–6, three alternative embodiments for spray directors are illustrated assembled in the recess 76 formed on the discharge side of valve seat 66 of the injector of FIG. 1. In FIG. 4, a spray director 114 is formed as a disc that is retained in the recess 76 by a cup-shaped retainer member 116 which may be press fitted or otherwise retained in the recess 76. A plurality of spray openings 118 are provided through the spray director disc 114 to direct the flow of fuel spray from the injector into the associated inlet runner or port, not shown.

FIG. 5 illustrates an alternative embodiment of identical construction with FIG. 4, except that the spray director 120 is now a cup-shaped element received in recess 76 and including spray openings 118 for directing fuel spray as before. Spray director 120 is again press fitted into the recess 76 for retention therein.

FIG. 6 illustrates another embodiment with a spray director 120 like that of FIG. 5. In this case, however, the spray director is provided with a combination of a retention lip 122 on one side and one or more spot welds 124 on the other side to more positively retain the director 120 in the recess 76. Alternatively, either a plurality of retention lips 122 or multiple spot welds could provide supplemental retention of the spray director. Obviously, these manners of retention could alternatively be applied to the embodiment of FIG. 4. The other components of FIGS. 5 and 6 are identical to those of FIG. 4 so that the reference numerals to these parts have been omitted for clarity.

Figure 7:
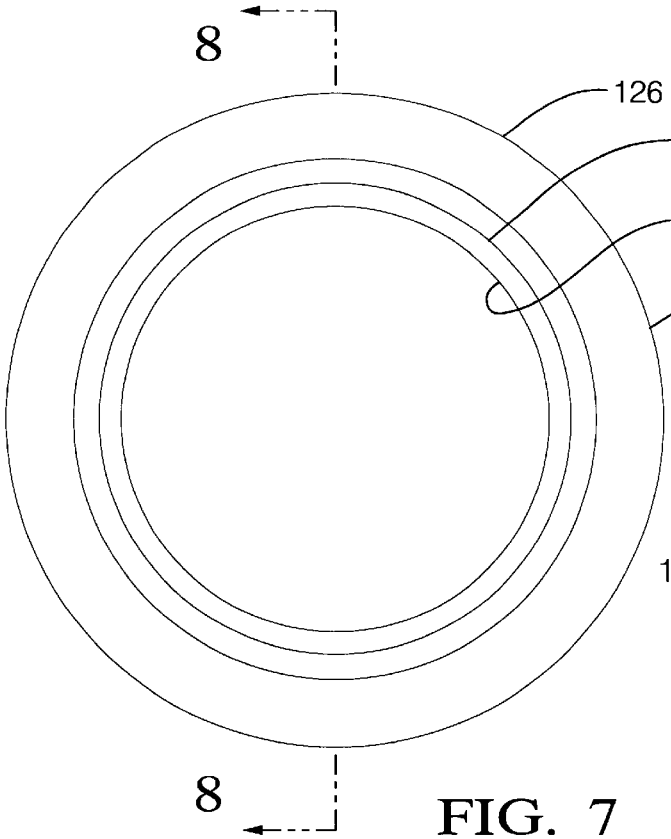
FIG. 7 is an inlet end view of a push-on rail seal retainer similar to that shown in FIG. 1.
Figure 8:
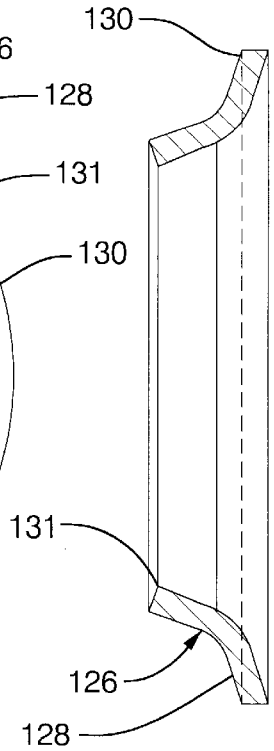
FIG. 8 is a cross-sectional view of the retainer of FIG. 7.

FIGS. 7–10 illustrate some alternative inlet seal retainer rings for use in place of retainer 38 shown in FIGS. 1 and 2. FIGS. 7 and 8 show a retainer 126 somewhat similar to retainer 38 and including a generally axially extending hub or gripping portion 128 which is connected with a generally radially extending flange portion 130. The hub 128 is resiliently expandable for sliding over the tube 12 or 84 and has a relatively sharp or narrow edge 131 so as to grip the tube and provide resistance against removal. The flange 130 is, of course, provided to engage and retain the O-ring 36 in position on the inlet end of the injector.

Figure 9:
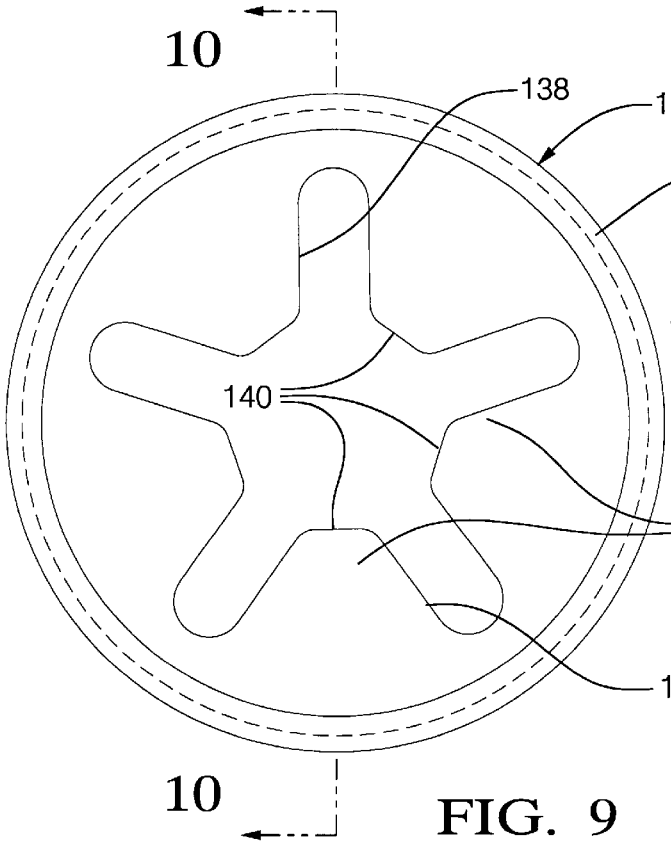
FIG. 9 is an inlet end view of an alternative push-on rail seal retainer including spring fingers.
Figure 10:
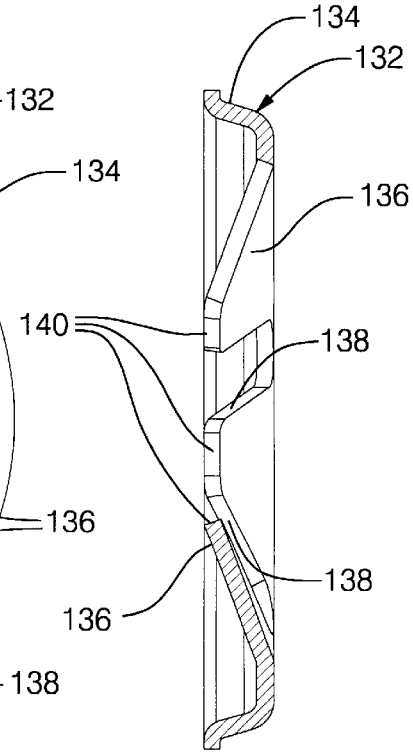
FIG. 10 is a cross-sectional view of the retainer of FIG. 9.

The alternative embodiment of FIGS. 9 and 10 features a spring fastener 132 having a curved outer stiffening flange 134 connecting inwardly with spring fingers 136 separated by slots 138 and having inner edges 140 which engage and grip the tube 12 or 84 when the fastener 132 is pressed thereon to act as a seal retainer. Alternatively, other forms of seal retainers and manners of retention of these retainers could be used, if desired.

An exemplary manner of assembly of a fuel injector according to the invention will now be described by reference to the embodiment of FIG. 1. The various components are first manufactured and partially preassembled where needed for final assembly of the entire injector. The coil assembly is preassembled in the manner previously indicated to provide a single unit ready for installation. The continuous endoskeletal injector tube 12 is preformed of suitable stainless steel material, or other suitable alternative material, having a constant diameter from its inner end 16 to adjacent the outer end 18 where the expanded diameter portion 50 is formed. If desired, the diameter of upper portions of the tube could also be varied but that might affect the exemplary manner of assembly being here described. The lower valve guide 68 and valve seat 66 containing the seal ring 80 are then inserted into the expanded diameter portion 50 and aligned, and the tube outer end is then crimped over to retain these elements in position.

One of the alternative spray director embodiments may be press fitted into the circular recess 76 either before or after installation of the valve seat in the expanded diameter portion 50 of the injector tube 12. The injection valve 56 and magnetic pole 54 may then be slid into the tube from the inlet end 16, the pole 54 being adjusted at some point thereafter to provide the proper gap for setting the stroke of the valve 56. The magnetic pole 54 is preferably fixed to the tube 12, as by welding, after adjustment to set the proper gap. Before or after this step, the spring 62 may be installed and the adjusting sleeve 64 is forced into magnetic pole 54 in the proper position for providing suitable compression of the spring 62 for biasing the injection valve toward the closed position.

The external members are then assembled on the outside of the injector tube 12, sliding them over the tube from the inlet end 16. First, the seal 48 is slid into position against the flange of the expanded diameter portion 50. Split spacer ring 46 may then be positioned against the seal or it may be added later. The coil body 24 is preferably made in two pieces which are assembled about the central portions of the coil assembly and the combined coil assembly and coil body are then slid over the inlet end of the tube and down into position with the lower end 28 of the two piece coil body received within the spacer ring 46 or around which the ring is subsequently installed. The ends 26, 28 of the coil body may be, but are not required to be, welded or otherwise fixed to the tube 12 at this time. Subsequently, the tubular support element 30 is slid over the inlet end of the tube with its lower end surrounding the upper end 26 of the body 24 and the seal ring 36 and push-on seal retainer 38 are finally applied. The assembled injector is then calibrated by adjusting the spring tension to obtain the desired fuel flow. Finally, fuel filter 52 is installed in the inlet end 16 of tube 12, completing assembly of the injector.

It may be seen that, preassembly of certain of the components and the use of the continuous tube as a skeleton in and on which the components of the injector are assembled provide considerable simplification of the final assembly process of the injector, thereby reducing the cost of manufacture. In addition, the imperforate continuous tube itself separates the fuel bathed elements within the tube from all of the external components including, particularly, the coil assembly. Thus, fuel is prevented from contacting the coil and the other external elements, thereby providing an extended life for the coil and preventing leakage of fuel other than at the connections at opposite ends of the injector with an associated fuel rail and an engine inlet runner or port of a manifold or cylinder head. The dual functions of support element 30 of providing seal backup as well as a clip groove, the preassembled structure of the coil assembly, and the dual function of the magnetic pole 54 as both a concentrator of magnetic force and an adjustable stop for the injection valve 56, along with various alternative embodiments of press fitted or otherwise retained spray directors and simple push-on seal retainers, all combine to provide a simplified and economical injector construction suitable for use in engines. Some of the various novel features included in the injector combination may, of course, also be utilized in other forms of injectors than those of the specific type shown, so that no limitation as to the scope of application of the various features is intended in their description as part of the previously described embodiments.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A method of assembling a fuel use in an engine, comprising the steps of:

providing an endoskeletal injector tube having an inlet and an outlet end;

affixing a valve seat assembly to the outlet end of the tube;

inserting an injector valve assembly into the inlet end of the tube;

sliding a coil assembly over the tube;

sliding a support element over the tube; and affixing a seal retainer onto the inlet end of the tube, thereby assembling the fuel injector.

2. A method of assembling a fuel injector for use in an engine, comprising the steps of:

providing an endoskeletal injector tube having an inlet end and an outlet end;

affixing a valve seat assembly to the outlet end of the tube;

inserting an injector valve assembly into the inlet end of the tube;

sliding a coil assembly over the tube;

sliding a support element over the tube; and affixing a seal retainer onto the inlet end of the tube, thereby assembling the fuel injector;

wherein the step of inserting an injector valve assembly further comprises the steps of:

sliding an injector valve into the inlet end of the tube;

sliding a magnetic pole into the inlet end of the tube, wherein the pole is adjustable thereafter for setting the stroke of the injector valve; and affixing the pole within the tube, thereby setting the stroke for the injector valve.

3. The method of claim 2 further comprising the steps of:

installing a spring into the tube for biasing the injector valve toward the valve seat assembly; and inserting a calibration sleeve into the pole, thereby compressing the spring.

4. The method of claim 3 further comprising the steps of calibrating the tension of spring by adjusting the sleeve; and installing a fuel filter into the inlet of the tube.

5. A method of assembling a fuel injector for use in an engine, comprising the steps of:

providing an endoskeletal injector tube having an inlet end and an outlet end;

affixing a valve seat assembly to the outlet end of the tube;

inserting an injector valve assembly into the inlet end of the tube;

sliding a sealing member over the tube;

positioning the sealing member into close proximity to the outlet end of the tube;

sliding a spacer ring over the tube;

positioning the spacer ring against the sealing member, and thereafter;

sliding a coil assembly over the tube;

sliding a support element over the tube; and affixing a seal retainer onto the inlet end of the tube, thereby assembling the fuel injector.

6. A fuel injector for use in an engine and comprising:

a tube enclosing a continuous passage for fuel flow from an inlet end to an outlet end of the tube;

a valve seat fixed in the outlet end of the tube and including a discharge opening;

an injection valve including a magnetic armature reciprocably movable in the tube between closed and open positions and biased toward the closed position, said valve engaging the valve seat and closing the discharge opening in the closed position, the valve being spaced from the valve seat and allowing fuel flow out of the discharge opening in the open position;

a tubular magnetic pole fixed within said tube and engagable by the valve in the open position;

a solenoid coil mounted on the tube and extending around said pole; and a magnetic body at least partially enclosing the coil and having upper and lower ends mounted on the tube;

wherein the body, pole and armature form a magnetic flux concentrating path operative to attract the armature to the pole and open the valve when the coil is energized, and the tube prevents fuel passing therethrough from contacting the coil which actuates the valve.

7. A fuel injector as in claim 6 wherein said pole is adjustable within said tube prior to being fixed therein for setting an operating stroke of the valve.

8. A fuel injector as in claim 6 wherein said coil is included in a separate coil assembly having an attached electrical connector, said assembly having a central opening through the coil for sliding the coil assembly onto the tube.

9. A fuel injector as in claim 8 wherein said coil assembly includes a wound wire coil connected with terminal means and supported in an encapsulating body.

10. A fuel injector as in claim 6 wherein said coil assembly includes a bobbin on which the wire coil is wound prior to formation of the assembly.

11. A fuel injector as in claim 6 including a support element mounted on the tube and having retaining means for connecting the injector to an associated fuel rail and a back-up surface for supporting a seal ring on the tube for insertion in a cup of a fuel rail.

12. A fuel injector as in claim 11 wherein said retaining means includes a groove for receiving a retainer clip.

13. A fuel injector as in claim 11 including a seal retainer fixed on said inlet end of the tube and spaced from said back-up surface to form with the tube an annular recess for receiving a seal ring, the seal retainer being adapted for push-on installation on the tube after application of the seal ring.

14. A fuel injector as in claim 13 wherein said seal retainer includes an opening defining edge with flexible means urging said edge into engagement with the tube.

15. A fuel injector as in claim 6 wherein said valve seat carries a director with multiple openings for directing spray delivery from the injector.

16. A fuel injector as in claim 15 wherein the director is integral with the valve seat.

17. A fuel injector as in claim 15 wherein the director is a separate member received in a recess of the value seat opening outward from the discharge opening.

18. A fuel injector as in claim 17 wherein the director is a disk retained by a cup shaped director retainer pressed into the recess.

19. A fuel injector as in claim 18 wherein the director retainer is supplementally fixed in the recess.

20. A fuel injector as in claim 15 wherein the director is formed as a cup shaped member pressed into the recess.

21. A fuel injector as in claim 20 wherein the director is supplementally fixed in the recess.

22. A fuel injector as in claim 6 wherein the tube is of constant diameter.

23. A fuel injector as in claim 6 wherein the valve seat is received in an expanded diameter portion of the tube.

24. A fuel injector as in claim 23 including a lower valve guide in the expanded diameter portion above the valve seat, the lower valve guide and valve seat being retained by crimping the lower outlet end of the tube.

25. A fuel injector for use in an engine, comprising:

an injector body having an axially extending fuel passage therein;

an injection valve movable in the passage;

a magnetic pole fixed within the passage of the body;

a solenoid assembly extending around said pole and at least partially enclosed by said body;

a valve seat fixed at an outlet end of the passage and having a discharge opening therethrough and a recess opening outward from the discharge opening; and a director with multiple openings for directing spray delivery from the injector, wherein the director is a cup-shaped member pressed into the recess of the valve seat.

26. A fuel injector for use in an engine, comprising:

an injector body having an axially extending fuel passage therein;

an injection valve movable in the passage;

a magnetic pole fixed within the passage of the body;

a solenoid assembly extending around said pole and at least partially enclosed by said body;

a valve seat fixed at an outlet end of the passage and having a discharge opening therethrough and a recess opening outward from the discharge opening; and a director with multiple openings for directing spray delivery from the injector, wherein the director is a cup-shaped member pressed into the recess of the valve seat and supplementally fixed within the recess.

27. The fuel injector of claim 26 wherein the valve seat further includes a retention lip for retaining said director in the recess.

28. The fuel injector of claim 25 wherein said injection valve further includes a magnetic armature reciprocably movable in the passage between closed and open positions, said injection valve engaging the valve seat and closing the discharge opening in the closed position, and said injection valve being spaced from the valve seat and allowing fuel flow out of the discharge opening in the open position.

29. The fuel injector of claim 25 wherein said injector body, said pole and said armature form a magnetic flux concentrating path operative to attract the armature to the pole when the coil assembly is energized, thereby opening the injection valve.

30. A fuel injector for use in an engine and comprising:

a tube enclosing a continuous passage for fuel flow from an inlet end to an outlet end of the tube;

a valve seat fixed in the outlet end of the tube and including a discharge opening, said valve seat carrying a director with multiple openings for directing spray delivery from the injector;

an injection valve including a magnetic armature reciprocably movable in the tube between closed and open positions and biased toward the closed position, said valve engaging the valve seat and closing the discharge opening in the closed position, the valve being spaced from the valve seat and allowing fuel flow out of the discharge opening in the open position;

a tubular magnetic pole fixed within said tube and engagable by the valve in the open position, the pole being adjustable within the tube prior to being fixed therein for setting the operating stroke of the valve;

a solenoid coil extending around said pole and included in a separate coil assembly mounted on the tube, the coil assembly including an attached electrical connector and having a central opening through the coil for sliding the coil assembly onto the tube;

a support element mounted on the tube and having retaining means for connecting the injector to an associated fuel rail and a back-up surface for supporting a seal ring on the tube for insertion in a cup of a fuel rail;

a seal retainer fixed on said inlet end of the tube and spaced from said back-up surface to form with the tube an annular recess for receiving a seal ring, the seal retainer being adapted for push-on installation on the tube after application of the seal ring; and a magnetic body at least partially enclosing the coil and having upper and lower ends mounted on the tube;

wherein the body, pole and armature form a magnetic flux concentrating path operative to attract the armature to the pole and open the valve when the coil is energized, and the tube prevents fuel passing therethrough from contacting the coil which actuates the valve.

* * * * *